US011250743B2

(12) United States Patent
Huang

(10) Patent No.: US 11,250,743 B2
(45) Date of Patent: Feb. 15, 2022

(54) DISPLAY, DISPLAY APPARATUS, AND GROUND RESISTOR ADJUSTMENT METHOD

(71) Applicants: CHONGQING HKC OPTOELECTRONICS TECHNOLOGY CO., LTD., Chongqing (CN); HKC CORPORATION LIMITED, Shenzhen (CN)

(72) Inventor: Xiaoyu Huang, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 505 days.

(21) Appl. No.: 16/313,062

(22) PCT Filed: Oct. 23, 2018

(86) PCT No.: PCT/CN2018/111331

§ 371 (c)(1),
(2) Date: Dec. 24, 2018

(87) PCT Pub. No.: WO2020/051991

PCT Pub. Date: Mar. 19, 2020

(65) Prior Publication Data

US 2021/0225220 A1 Jul. 22, 2021

(30) Foreign Application Priority Data

Sep. 11, 2018 (CN) ..... 201811055267.5

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2310/08* (2013.01)

(58) Field of Classification Search
CPC .. G09G 3/006; G09G 3/3648; G09G 2310/08; G09G 2330/00; G09G 2330/04; G09G 2330/08; G09G 2330/12
See application file for complete search history.

(56) References Cited

U.S. PATENT DOCUMENTS 5,566,080 A * 10/1996 Yokoi ..... G06F 30/39 716/122
6,166,713 A 12/2000 Asai et al.
(Continued)

FOREIGN PATENT DOCUMENTS

CN 1671267 A 9/2005
CN 101964890 2/2011
(Continued)

OTHER PUBLICATIONS

Shikui Liu, the ISA written comments, Jun. 2019, CN.

*Primary Examiner* — Antonio Xavier

(57) ABSTRACT

This application discloses a display, a display apparatus, and a ground resistor adjustment method. The display includes: a drive circuit of a display panel, an integrated end circuit, and an adjustable resistance circuit, where the adjustable resistance circuit controls and adjusts a resistance value between the drive circuit of the display panel and the integrated end circuit.

15 Claims, 2 Drawing Sheets

(56) References Cited

U.S. PATENT DOCUMENTS

| | | | | |
|---|---|---|---|---|
| 2004/0113881 | A1* | 6/2004 | Kim | G09G 3/3651 345/97 |
| 2006/0244692 | A1* | 11/2006 | Yoo | G09G 3/3275 345/76 |
| 2009/0073149 | A1* | 3/2009 | Matsumoto | H01L 29/78696 345/206 |
| 2010/0007680 | A1* | 1/2010 | Yu | G09G 5/10 345/690 |
| 2010/0277513 | A1* | 11/2010 | Byun | G09G 3/3291 345/690 |
| 2013/0124140 | A1* | 5/2013 | Jang | G06F 3/0446 702/150 |
| 2014/0146426 | A1* | 5/2014 | Murakami | G02F 1/136204 361/56 |
| 2014/0184482 | A1* | 7/2014 | Zhang | G09G 3/3406 345/87 |
| 2016/0259220 | A1* | 9/2016 | Huang | G09G 3/3611 |
| 2017/0229076 | A1* | 8/2017 | Zhou | G09G 3/3688 |
| 2019/0206332 | A1* | 7/2019 | Park | G09G 3/3275 |
| 2019/0272798 | A1* | 9/2019 | Hwang | G09G 3/3611 |

FOREIGN PATENT DOCUMENTS

| | | |
|---|---|---|
| CN | 102801982 | 11/2012 |
| CN | 102867492 | 1/2013 |
| CN | 104635137 | 5/2015 |
| CN | 204422579 | 6/2015 |
| CN | 205665677 | 10/2016 |
| CN | 106228938 A | 12/2016 |

* cited by examiner

DISPLAY, DISPLAY APPARATUS, AND GROUND RESISTOR ADJUSTMENT METHOD

This application claims priority to Chinese Patent Application No. CN201811055267.5, filed with the Chinese Patent Office on Sep. 11, 2018 and entitled "DISPLAY, DISPLAY APPARATUS, AND GROUND RESISTOR ADJUSTMENT MFTHOD", which is incorporated herein by reference in its entirety.

TECHNICAL FIELD

This application relates to the field of display technologies, and more specifically, to a display, a display apparatus, and a ground resistor adjustment method.

BACKGROUND

A display is usually referred. to as a monitor. The display is an I/O device of a computer; that is, an input/output device. The display is a display tool that displays an electronic document through a particular transmission device on a screen and reflects the electronic document on human eyes.

A thin film transistor liquid crystal display (TFT-LCD) is a main type of current flat panel display and has become an important display platform in modern IT and video products. The TFT-LCD includes a system mainboard, an integrated backplane, a display area, and a printed circuit board (PCB). The system mainboard connects an R/G/B compressed signal, a control signal, and a power source to a connector on the PCB through a wire, and after being processed by a timing controller (TCON) IC on the PCB, data is connected to the display area via the PCB and through a source-chip on film (S-COF) and a gate-chip on film (G-COF), so that the LCD obtains required power sources and signals. To ensure effects of an electrostatic withstanding test and an electromagnetic compatibility test, GND within the PCB needs to be connected to GND on the integrated backplane after passing through a ground resistor, to ensure that static electricity and radiation are released through an integrated machine.

In actual application, the effects of the electrostatic withstanding test and the electromagnetic compatibility test are poor, and a resistance value of the ground resistor needs to be adjusted according to actual experiment effects, causing inconvenience.

SUMMARY

In view of the foregoing defect, this application provides a display and a ground resistor adjustment method of a display that are more coin tested.

To achieve the foregoing objective, this application provides a display, comprising:

a drive circuit of a display panel, an integrated end circuit, and an adjustable resistance circuit, wherein a ground end of the drive circuit of the display panel is conducted with a ground end of an integrated end circuit board through the adjustable resistance circuit; and the adjustable resistance circuit controls and adjusts a resistance value between the drive circuit of the display panel and the integrated end circuit.

Optionally, the adjustable resistance circuit comprises:

a first resistor; a second resistor, which having a resistance value different from that of the first resistor: and a switching circuit, in control connection with the first resistor and the second resistor, wherein the switching circuit is in communication with the drive circuit of the display panel to receive a switching signal;

when the switching signal received by the switching circuit is a first switching signal, the switching circuit connects the first resistor between the ground end of the drive circuit of the display panel and the ground end of the integrated end circuit hoard;

when the switching signal received by the switching circuit is a second switching signal, the switching circuit connects the second resistor between the, ground end of the drive circuit of the display panel and the ground end of the integrated end circuit board.

Optionally, the drive circuit of the display panel comprises a timing controller, and the switching circuit is in communication with the timing controller to receive the switching signal.

Optionally, the switching circuit comprises:

a first switch, wherein a first end of the first switch is coupled to the first resistor, a second end of the first switch is coupled to and connected to the ground end of the integrated end circuit board, and a control end of the first switch is coupled to the switching signal; and a second switch, wherein a first end of the second switch is coupled to the second resistor, a second end of the second switch is coupled to the ground end of the integrated end circuit board, and a control end of the second switch is coupled to the switching signal, wherein when the first switch is turned on, the second switch is turned off; and when the first switch is turned off, the second switch is turned on.

Optionally, the control end of the first switch is positive, and the control end of the second switch is negative; or the control end of the first switch is negative, and the control end of the second switch is positive.

Optionally, the first switch is an NMOS tube, is turned on when the switching signal is at a high level, and is turned off when the switching signal is at a low level: and the second switch is a PMOS tube, is turned on when the switching signal is at a low level, and is turned off when the switching signal is at a high level.

Optionally, the drive circuit of the display panel comprises a system movement, and the switching circuit is in communication with the system movement to receive the switching signal.

Optionally, the switching circuit comprises:

a D trigger;

a first switch; and a second switch;

the system movement is in communication with a control end of the D trigger to connect the switching signal, and an output end of the D trigger is connected to control ends of both the first switch and the second switch and controls the first switch or the second switch to be conducted;

a third resistor is connected between the output end of the D trigger and the first switch and the second switch, and the other end of the third resistor is connected to the ground end of the drive circuit of the display panel;

when the switching signal is a first switching signal, and a logic voltage end of the D trigger is at a high level, the first switching signal enters through the control end of the D trigger and outputs a first control signal through the output end of the D trigger, to control the first switch to be conducted and the second switch to be turned off;

when the switching signal is a second switching signal, and the logic voltage end of the D trigger is at a high level, the first switching signal enters through the control end of the D trigger and outputs a second control signal through the output end of the D trigger, to control the second switch to be conducted and the first switch to be turned off; and the system movement and the D trigger are connected through a connector.

Optionally, system movement and the D trigger are connected through the connector.

This application discloses a display, comprising: a drive circuit of a display panel, an integrated end circuit, and an adjustable resistance circuit, wherein a ground end of the drive circuit of the display panel is conducted with a ground end of an integrated end circuit board through the adjustable resistance circuit;

the adjustable resistance circuit controls and adjusts a resistance value between the drive circuit of the display panel and the integrated end circuit;

the adjustable resistance circuit comprises:

a first resistor; a second resistor, having a resistance value different from that of the first resistor; and a switching circuit, in control connection with the first resistor and the second resistor, wherein the switching circuit is in communication with the drive circuit of the display panel to receive a switching signal;

when the switching signal received by the switching circuit is a first switching signal, the switching circuit connects the first resistor between the ground end of the drive circuit of the display panel and the ground end of the integrated end circuit board; and when the switching signal received by the switching circuit is a second switching signal, the switching circuit connects the second resistor between the ground end of the drive circuit of the display panel and the ground end of the integrated end circuit board;

the drive circuit of the display panel comprises a timing controller, and the switching circuit is in communication with the timing controller to receive the switching signal;

the switching circuit comprises:

a first switch, wherein a first end of the first switch is coupled to the first resistor, a second end of the first switch is coupled to and connected to the ground end of the integrated end circuit board, and a control end of the first switch is coupled to the switching signal; and a second switch, wherein a first end of the second switch is coupled to the second resistor, a second end of the second switch is coupled to the ground end of the integrated end circuit board, and a control end of the second switch is coupled to the switching signal, wherein when the first switch is turned on, the second switch is turned off;

when the first switch is turned off, the second switch is turned on; and the control end of the first switch is positive, and the control end of the second switch is negative; or the control end of the first switch is negative, and the control end of the second switch is positive.

This application further discloses a ground resistor adjustment method of a display.

The display comprises:

a drive circuit of a display panel, an integrated end circuit, and an adjustable resistance circuit, wherein a ground end of the drive circuit of the display panel is conducted with a ground end of an integrated end circuit board through the adjustable resistance circuit;

the adjustable resistance circuit comprises:

a first resistor; a second resistor having a resistance value different from that of the first resistor, and a switching circuit in control connection with the first resistor and the second resistor, the switching circuit being in communication with the drive circuit of the display panel to receive a switching signal; and the ground resistor adjustment method comprises the following steps:

when a first switching signal is received, controlling the first resistor to be connected between the ground end of the drive circuit of the display panel and the ground end of the integrated end circuit board; and when a second switching signal is received, controlling the second resistor to be connected between the ground end of the drive circuit of the display panel and the ground end of the integrated end circuit board.

Optionally, the drive circuit of the display panel comprises a timing controller, and the switching circuit is in communication with the timing controller to receive the switching signal;

the switching circuit comprises a first switch and a second switch;

when the switching signal is at a high level, the first switch is conducted, a control end of the first switch is in communication with the timing controller to receive the switching signal, a first end of the first switch is in communication with the first resistor and the ground end of the drive circuit of the display panel, a second end of the first switch is in communication with the ground end of the integrated end circuit board, and a ground resistor connected between the ground end of the drive circuit of the display panel and the ground end of the integrated end circuit board is the first resistor; and when the switching signal is at a low level, when the second switch is turned on, a control end of the second switch is in communication with the timing controller to receive the switching signal, a first end of the second switch is in communication with the second resistor and the ground end of the drive circuit of the display panel, a second end of the second switch is in communication with the ground end of the integrated end circuit board, and a ground resistor connected between the ground end of the drive circuit of the display panel and the ground end of the integrated end circuit board is the second resistor.

Optionally, the drive circuit of the display panel comprises a system movement, and the switching circuit is in communication with the system movement to receive the switching signal;

the switching circuit comprises:

a D trigger;

a first switch; and a second switch;

the system movement is in communication with a control end of the D trigger to connect the switching signal, and an output end of the D trigger is in control connection with both the first switch and the second switch and controls the first switch or the second switch to be conducted;

a third resistor is connected between the output end of the D trigger and the first switch and the second switch, and the other end of the third resistor is connected to the ground end of the drive circuit of the display panel;

when the switching signal is a first switching signal, and a logic voltage end of the D trigger is at a high level, the first switching signal enters through the control end of the D trigger and outputs a first control signal through the output end of the D trigger, to control the first switch to be conducted and the second switch to be turned off; and when the switching signal is a second switching signal, and the logic voltage end of the D trigger is at a high level, the first switching signal enters through the control end of the D trigger and outputs a second control signal through the output end of the D trigger, to control the second switch to be conducted and the first switch to be turned off.

This application further discloses a display apparatus, comprising the display.

In this application, to ensure effects of an electrostatic withstanding test and an electromagnetic compatibility test, the ground end of the drive circuit of the display panel is conducted with the ground end of the integrated end circuit board through the adjustable resistance circuit. When detection effects of the electrostatic withstanding test and the electromagnetic compatibility test are poor, a resistance value of the ground resistor may be controlled according to a specific detection result and directly through the switching signal of the adjustable resistance circuit, and the resistance value of the ground resistor may be adjusted without physically changing a resistor on the circuit board, to ensure that static electricity and radiation are released through the integrated machine, which is very convenient.

BRIEF DESCRIPTION OF DRAWINGS

The accompanying drawings included are used to provide further understanding of the embodiments of this application, constitute a part of the specification, and are used to illustrate implementations of this application and explain the principle of this application together with literal descriptions. Apparently, the accompanying drawings in the following descriptions are merely some embodiments of this application, and a person of ordinary skill in the art can also obtain other accompanying drawings according to these accompanying drawings without contributing any creative effort. In the accompanying drawings.

DETAILED DESCRIPTION

Figure 1:
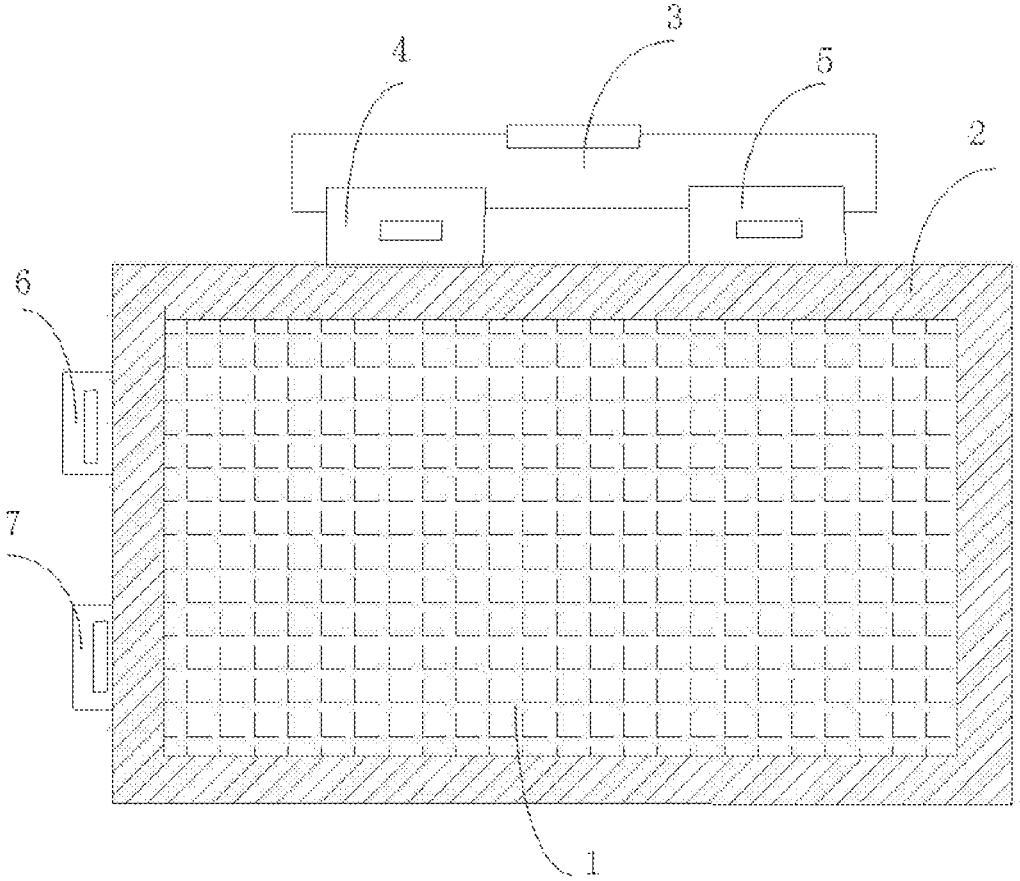
FIG. 1 is a schematic diagram of a TFT-LCD architecture diagram according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside" and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Hence, features defined by "first" or "second" may explicitly indicate or implicitly include one or more of the features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection. through an intermediary, or internal communication between two components. A person of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

In figures, units with similar structures are, represented by using a same reference number.

This application is further described below with reference to the accompanying drawings and embodiments.

As shown in FIG. 1 to FIG. 4, an embodiment of this application discloses a display, including:

a drive circuit 10 of a display panel, an integrated end circuit 30, and an adjustable resistance circuit 20, where a ground end GND_1 of the drive circuit 10 of the display panel is conducted with a round end GND_2 of the integrated end circuit 30 through the adjustable resistance circuit 20; and the adjustable resistance circuit 20 controls and adjusts a resistance value between the drive circuit 10 of the display panel and the integrated end circuit 30.

In this application, to ensure effects of an electrostatic withstanding test and an electromagnetic compatibility test, the ground end GND_1 of the drive circuit 10 of the display panel is conducted with the ground end GND_2 of the integrated end circuit 30 through the adjustable resistance circuit 20. When detection effects of the electrostatic withstanding test and the electromagnetic compatibility test are poor, a resistance value of the ground resistor may be controlled according to a specific detection result and directly through the switching signal of the adjustable resistance circuit 20, and the resistance value of the ground resistor may be adjusted without physically changing a resistor on the circuit board, to ensure that static electricity and radiation are released through the integrated machine, which is very convenient.

In this embodiment, optionally, the adjustable resistance circuit 20 includes:

a first resistor R1; a second resistor R2, having a resistance value different from that of the first resistor R1; and a switching circuit 21, in control connection with the first resistor R1 and the second resistor R2, where the switching circuit 21 is in communication with the drive circuit 10 of the display panel to receive a switching signal;

when the switching signal received by the switching circuit 21 is a first switching signal, the switching circuit 21 connects the first resistor R1 between the ground end GND_1 of the drive circuit 10 of the display panel and the ground end GND_2 of the integrated end circuit 30; and when the switching signal received by the switching circuit 21 is a second switching signal, the switching circuit 21 connects the second resistor R2 between the ground end GND_1 of the drive circuit 10 of the display panel and the ground end GND_2 of the integrated end circuit 30.

In this solution, the switching signal is received through communication between the switching circuit 21 and the drive circuit 10 of the display panel. When the switching signal is the first switching signal, the switching circuit 21 controls the first resistor R1 to be connected between the ground end GND_1 of the drive circuit 10 of the display panel and the ground end GND_2 of the integrated end circuit 30. When the switching signal is the second switching signal, the switching circuit 21 controls the second resistor R2 to be connected between the ground end GND_1 of the drive circuit 10 of the display panel and the ground end GND_2 of the integrated end circuit 30. When the switching signals are different, different ground resistors are Obtained, to ensure that static electricity and radiation are released through the integrated machine and improve elasticity of product development.

Figure 3:
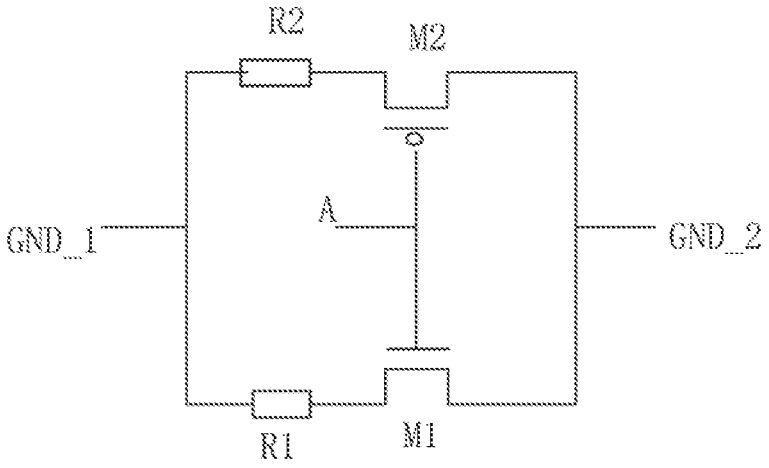
FIG. 3 is a specific circuit diagram of another ground resistor adjustment method of a display according to an embodiment of tins application.
Figure 4:
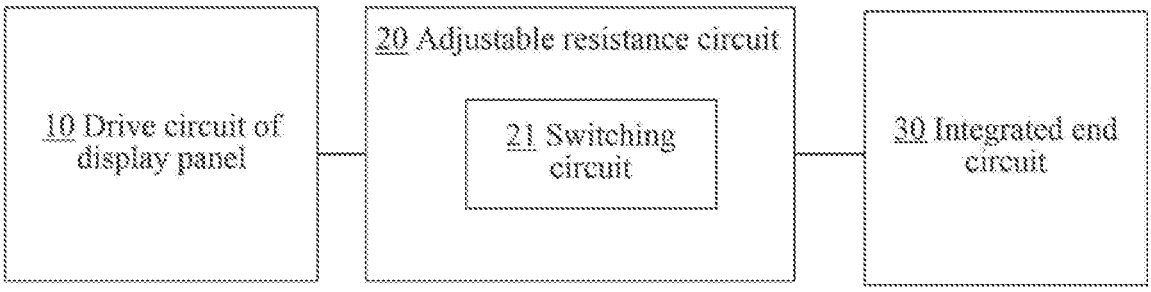
FIG. 4 is an application flowchart of a ground resistor adjustment method of a display according to an embodiment of this application.

Referring to FIG. 3, the drive circuit 10 of the display panel includes a timing controller A, and the switching circuit 21 is in communication with the timing controller A to receive the switching signal.

In this solution, the drive circuit 10 of the display panel includes the timing controller, the switching circuit 21 is in communication with the timing controller to receive the switching signal. When the electrostatic withstanding test or the electromagnetic compatibility test has poor effects, and the ground resistor needs to be changed, in this case, only software within the timing controller needs to be updated, and the operation is convenient.

In this embodiment, optionally, the switching circuit 21 includes:

a first switch, where a first end of the first switch is coupled to the first resistor R1, a second end of the first switch is coupled to and connected to the ground end GND_2 of the integrated end circuit 30, and a control end of the first switch is coupled to the switching signal; and a second switch. Where a first end of the second switch is coupled to the second resistor R2, a second end of the second switch is coupled to the ground end GND_2 of the integrated end circuit 30, and a control end of the second switch is coupled to the switching signal, where when the first switch is turned on, the second switch is turned off; and when the first switch is turned off, the second switch is turned on.

In this implementation solution, when the switching signal received by the first switch is the first switching signal, when the first switch is turned on, the second switch is turned off, the control end of the first switch is in communication with the timing controller to receive the switching signal, the first end of the first switch is in communication with the first resistor R1 and the ground end GND_1 of the drive circuit 10 of the display panel, and the second end of the first switch is in communication with the ground end of the integrated end circuit 30, to form a closed loop. In this case, a ground resistor connected between the ground end GND_1 of the drive circuit 10 of the display panel and the ground end GND_2 of the integrated end circuit 30 is the first resistor R1. When the switching signal received by the first switch is the second switching signal, the second switch is turned on, the first switch is turned off, the first end of the second switch is in communication with the second resistor R2 and the ground end GND_1 of the drive circuit 10 of the display panel, the second end of the second switch is connected to the around end GND_2 of the integrated end circuit 30, to form a closed loop. In this case, a ground resistor connected between the ground end GND_1 of the drive circuit 10 of the display panel and the ground end GND_2 of the integrated end circuit 30 is the second resistor R2.

In this embodiment, optionally, the control end of the first switch M1 is positive, and the control end of the second switch M2 is negative; or the control end of the first switch M1 is negative, and the control end, of the second switch M2 is positive.

The first switch M1 may be an NMOS tube, is turned on when the switching signal is at a high level, and is turned off when the switching signal is at a low level; and the second switch M2 is a PMOS tube, is turned on when the switching signal is at a low level, and is turned off when the switching signal is at a high level.

In this implementation solution, the first switch M1 is an NMOS tube, and the second switch is a PMOS tube. When the switching signal is the first switching signal, and the first switching signal is at a high level, the NMOS tube is opened, the switching signal is in communication with a gate of the NMOS tube, a source of the NMOS tube is coupled to the first resistor R1, the other end of the first resistor R1 is connected to the ground end GND_1 of the drive circuit 10 of the display panel, and a drain of the NMOS tube is coupled to and connected to the ground end GND_2 of the integrated end circuit 30, to form a closed loop. In this case, a ground resistor connected between the ground end GND_1 of the drive circuit 10 of the display panel and the ground end GND_2 of the integrated end circuit 30 is the first resistor R1. When the switching signal is the second switching signal, and the second switching signal is at a low level, the PMOS tube is opened, the switching signal is in communication with a gate of the PMOS tube, a source of the PMOS tube is coupled to the second resistor R2. the other end of the second resistor R2 is connected to the ground end GND_1 of the drive circuit 10 of the display panel, and a drain of the PMOS tube is coupled to and connected to the ground end GND_2 of the integrated end circuit 30, to form a closed loop. In this case, a ground resistor connected between the ground end GND_1 of the drive circuit 10 of the display panel and the ground end. GND_2 of the integrated end circuit 30 is the first resistor R1.

Optionally, the drive circuit 10 of the display panel includes a system movement, and the switching circuit 21 is in communication with the system movement to receive the switching signal.

In this implementation solution, the switching circuit 21 is in communication with the system movement to receive the switching signal. When effects of the electrostatic withstanding test or the electromagnetic compatibility test, and the ground resistor needs to be changed, the first switching signal generated by the system movement and a signal output by the system movement are reliable.

Figure 2:
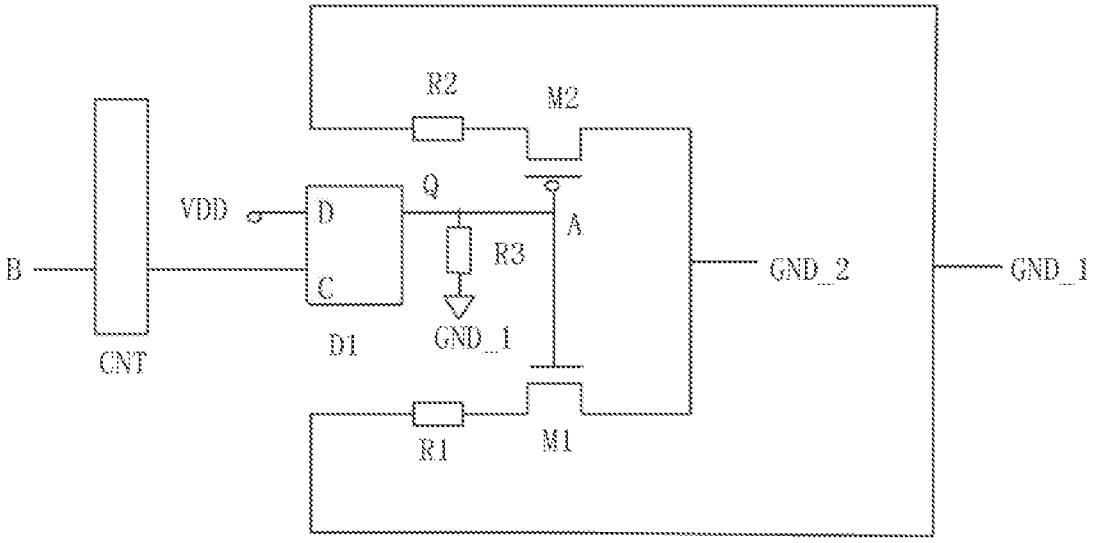
FIG. 2 is a specific circuit diagram of a ground resistor adjustment method of a display according to an embodiment of this application.

In another embodiment of this application, referring to FIG. 2, the drive circuit 10 of the display panel includes a system movement, and the switching circuit 21 is in communication with the system movement to receive the switching signal;

the switching circuit 21 includes:

a D trigger D1;

a first switch; and a second switch;

the system movement is in communication with a control end of the D trigger D1 to connect the switching signal, and an output end of the D trigger D1 is connected to control ends of both the first switch and the second switch and controls the first switch or the second switch to be conducted;

a third resistor R3 is connected between the output end of the D trigger D1 and the first switch and the second switch, and the other end of the third resistor R3 is connected to the ground end GND_1 of the drive circuit 10 of the display panel;

when the switching signal is a first switching signal, and a logic voltage end of the D trigger D1 is at a high level, the first switching signal enters through the control end of the D trigger D1 and outputs a first control signal through the output end of the D trigger D1, to control the first switch to be conducted and the second switch to be turned off;

when the switching signal is a second switching signal, and a logic voltage end of the D trigger D1 is at a high level, the first switching signal enters through the control end of the D trigger D1 and outputs a second control signal through the output end of the D trigger D1, to control the second switch to be conducted and the first switch to be turned off; and the system movement and the D trigger D1 are connected through a connector CNT.

The first resistor, the second resistor, and the third resistor have different resistance values.

In an actual application, the system movement is in communication with the control end of the D trigger D1 to connect the switching signal. When the switching signal is the first switching signal, because of a grounding action of the third resistor R3, in this case, the D trigger D1 has no output. In this case, the first switch is turned on, and the second switch is turned off. In this case, the ground resistor connected between the ground end GND_1 of the drive circuit 10 of the display panel and the ground end GND_2 of the integrated end circuit 30 is the first resistor R1. When the electrostatic withstanding test or the electromagnetic compatibility test has poor effects, and the ground resistor needs to be changed, in this case, only input of the system movement needs to be changed as the second switching signal, the first switch is turned off, and the second switch is turned on. In this case, the ground resistor connected between the ground end GND_1 of the drive circuit 10 of the display panel and the ground end GND_2 of the integrated end circuit 30 is the second resistor R2.

Optionally, the system movement and the D trigger D1 are connected through the connector CNT.

In this implementation solution, the system movement and the D trigger Di are connected through the connector CNT, so that connection to the system movement is more convenient.

Referring to FIG. 3, this application discloses a display 101, including: a drive circuit 10 of a display panel, an integrated end circuit 30, and an adjustable resistance circuit 20, where a ground end GND_1 of the drive circuit 10 of the display panel is conducted with a ground end GND_2 of the integrated end circuit 30 through the adjustable resistance circuit 20;

the adjustable resistance circuit 20 controls and adjusts a resistance value between the drive, circuit 10 of the display panel and the integrated end circuit 30;

the adjustable resistance circuit 20 includes:

a first resistor R1; a second resistor R2, having a resistance value different from that of the first resistor R1; and a switching circuit 21, in control connection with the first resistor R1 and the second resistor R2, where the switching circuit 21 is in communication with the drive circuit 10 of the display panel to receive a switching signal;

when the switching signal received by the switching circuit 21 is a first switching signal, the switching circuit connects the first resistor R1 between the ground end GND_1 of the drive circuit 10 of the display panel and the ground end GND_2 of the integrated end circuit 30;

when the switching signal received by the switching circuit 21 is a second switching signal, the switching circuit 21 connects the second resistor R2 between the ground end GND_1 of the drive circuit 10 of the display panel and the ground end GND_2 of the integrated end circuit 30;

the drive circuit 10 of the display panel includes a timing controller, and the switching circuit 21 is in communication with the timing controller to receive the switching signal;

the switching circuit 21 includes:

a first switch, where a first end of the first switch is coupled to the first resistor R1, a second end of the first switch is coupled to and connected to the ground end GND_2 of the integrated end circuit 30, and a control end of the first switch is coupled to the switching signal; and a second switch, where a first end of the second switch is coupled to the second resistor R2, a second end of the second switch is coupled to the ground end GND_2 of the integrated end circuit 30, and a control end of the second switch is coupled to the switching signal, where when the first switch is turned on, the second switch is turned off; and when the first switch is turned off, the second switch is turned on; and the control end of the first switch M1 is positive, and the control end of the second switch M2 is negative; or the control end of the first switch M1 is negative, and the control end of the second switch M2 is positive.

In this application, to ensure effects of an electrostatic withstanding test and an electromagnetic compatibility test, the ground end GND_1 of the drive circuit 10 of the display panel is conducted with the ground end GND_2 of the integrated end circuit 30 through the adjustable resistance circuit 20. When detection effects of the electrostatic withstanding test and the electromagnetic compatibility test are poor, a resistance value of the ground resistor may be controlled according to a specific detection result and directly through the switching signal of the adjustable resistance circuit 20, and the resistance value of the ground resistor may be adjusted without physically Changing a resistor on the circuit board, to ensure that static electricity and radiation are released through the integrated machine, which is very convenient.

In another embodiment of this application, referring to FIG. 1 to FIG. 4, this application further discloses a ground resistor adjustment method of a display 101.

The display 101 includes:

a drive circuit 10 of a display panel, an integrated end circuit 30, and an adjustable resistance circuit 20, where a ground end GND_1 of the drive circuit 10 of the display panel is conducted with a ground end GND_2 of the integrated end circuit 30 through the adjustable resistance circuit 20;

the adjustable resistance circuit 20 includes:

a first resistor R1; a second resistor R2, having a resistance value different from that of the first resistor R1; and a switching circuit 21, in control connection with the first resistor R1 and the second resistor R2, where the switching circuit 21 is in communication with the drive circuit 10 of the display panel to receive a switching signal; and when a first switching signal is received, the first resistor R1 is controlled to be connected between the ground end GND_1 of the drive circuit 10 of the display panel, and the ground end GND_2 of the integrated end circuit 30 and when a second switching signal is received, the second resistor R2 is controlled to be connected between the ground end GND_1 of the drive circuit 10 of the display panel and the ground end GND_2 of the integrated end circuit 30.

In this solution, the switching signal is received through communication between the switching circuit 21 and the drive circuit 10 of the display panel. When the switching signal is the first switching signal, the switching circuit 21 controls the first resistor R1 to be connected between the ground end GND_1 of the drive circuit 10 of the display panel and the ground end GND_2 of the integrated end circuit 30. When the switching signal is the second switching signal, the switching circuit 21 controls the second resistor R2 to be connected between the around end GND_1 of the drive circuit 10 of the display panel and the ground end GND_2 of the integrated end circuit 30. When the switching signals are different, different ground resistors are obtained, to ensure that static electricity and radiation are released through the integrated machine and improve elasticity of product development.

In this embodiment, optionally the drive circuit 10 of the display panel includes a timing controller, and the switching circuit 21 is in communication with the timing controller to receive the switching signal;

the switching circuit 21 includes a first switch and a second switch;

when the switching signal is at a high level, the first switch is conducted, a control end of the first switch is in communication with the timing controller to receive the switching signal, a first end of the first switch is in communication with the first resistor R1 and the ground end GND_1 of the drive circuit 10 of the display panel, a second end of the first switch is in communication with the ground end GND_2 of the integrated end circuit 30, and a ground resistor connected between the ground end GND_1 of the drive circuit 10 of the display panel and the ground end GND_2 of the integrated end circuit 30 is the first resistor R1; and when the switching signal is at a low level, when the second switch is turned on, a control end of the second switch is in communication with the timing controller to receive the switching signal, a first end of the second switch is in communication with the second resistor R2 and the ground end GND_1 of the drive: circuit 10 of the display panel, a second end of the second switch is in communication with the ground end GND_2 of the integrated end circuit 30, and a ground resistor connected between the ground end GND_1 of the drive circuit 10 of the display panel and the ground end GND_2 of the integrated end circuit 30 is the second resistor R2.

In this implementation solution, when the switching signal received by the first switch is the first switching sural, when the first switch is turned on, the second switch is turned off, the control end of the first switch is in communication with the timing controller to receive the switching signal, the first end of the first switch is in communication with the first resistor R1 and the ground end GND_1 of the drive circuit 10 of the display panel, and the second end of the first switch is in communication with the ground end of the integrated end circuit 30, to form a closed loop. In this case, a ground resistor connected between the ground end GND_1 of the drive circuit 10 of the display panel and the ground end GND_2 of the integrated end circuit 30 is the first resistor R1. When the switching signal received by the first switch is the second switching signal, the second switch is turned on, the first switch is turned off, the first end of the second switch is in communication with the second resistor R2 and the round end GND_1 of the drive circuit 10 of the display panel, the second end of the second switch is connected to the ground end GND_2 of the integrated end circuit 30, to form a closed loop. In this case, a ground resistor connected between the ground end GND_1 of the drive circuit 10 of the display panel and the ground end GND_2 of the integrated end circuit 30 is the second resistor R2.

In this embodiment, optionally the drive circuit 10 of the display panel includes a system movement B, and the switching circuit 21 is in communication with the system movement to receive the switching signal;

the switching circuit 21 includes:

a D trigger D1;

a first switch; and a second switch;

the system movement is in communication with a control end of the D trigger D1 to connect the switching signal, and an output end of the D trigger D1 is in control connection with both the first switch and the second switch and controls the first switch or the second switch to be conducted;

a third resistor R3 is connected between the output end of the D trigger D1 and the first switch and the second switch, and the other end of the third resistor R3 is connected to the ground end GND_1 of the drive circuit 10 of the display panel;

when the switching signal is a first switching signal, and a logic voltage end of the D trigger D1 is at a high level, the first switching signal enters through the control end of the D trigger D1 and outputs a first control signal through the output end of the D trigger D1, to control the first switch to be conducted and the second switch to be turned off: and when the switching signal is a second switching signal, and a logic voltage end of the D trigger D1 is at a high level, the first switching signal enters through the control end of the D trigger D1 and outputs a second control signal through the output end of the D trigger D1, to control the second switch to be conducted and the first switch to be turned off.

In an actual application, the system movement is in communication with the control end of the D trigger D1 to connect the switching signal. When the switching signal is the first switching signal, because of a grounding action of the third resistor R3, in this case, the D trigger D1 has no output. In this case, the first switch is turned on, and the second switch is turned off. In this case, the ground resistor connected between the ground end GND_1 of the drive circuit 10 of the display panel and the ground end GND_2 of the integrated end circuit 30 is the first resistor R1. When the electrostatic withstanding test or the electromagnetic compatibility test has poor effects, and the ground resistor needs to be changed, in this case, only input of the system movement needs to be changed as the second switching signal, the first switch is turned off, and the second switch is turned on. In this case, the ground resistor connected between the ground end GND_1 of the drive circuit 10 of the display panel and the ground end GND_2 of the integrated end circuit 30 is the second resistor R2.

Figure 5:
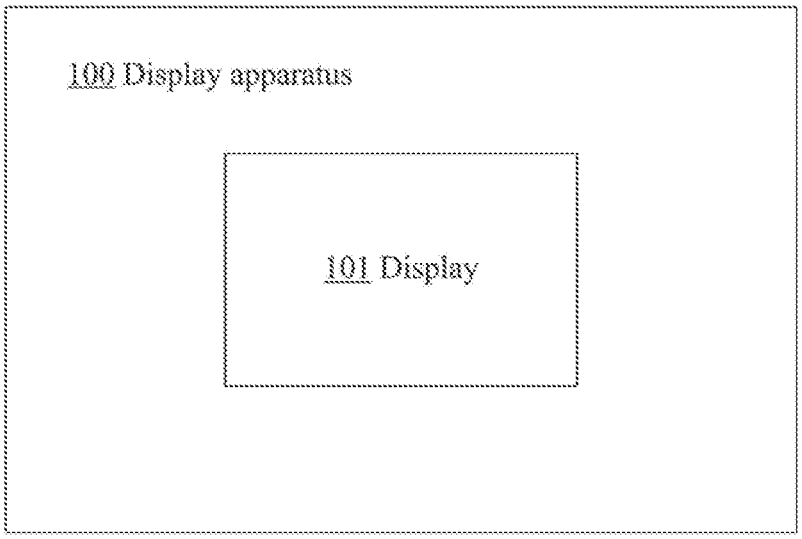
FIG. 5 is a schematic block diagram of a display apparatus according to an embodiment of this application.

In another embodiment of this application, referring to FIG. 5, this application further discloses a display apparatus 100, including the display 101.

The panel in this application may be a twisted nematic (TN) panel, an in-plane switching (IPS) panel, or a multi-domain vertical alignment (VA) panel, and may certainly be any other suitable type of panel.

The foregoing contents are detailed descriptions of this application in conjunction with specific embodiments, and it should not be considered that the specific implementation of this application is limited to these descriptions. A person of ordinary skill in the art can further make simple deductions or replacements without departing from the concept of this application, and such deductions or replacements should all be considered as falling within the protection scope of this application.

What is claimed is:

1. A display, comprising:

a drive circuit of a display panel;

an integrated end circuit; and an adjustable resistance circuit, wherein a ground end of the drive circuit of the display panel is conducted with a ground end of an integrated end circuit. board through the adjustable resistance circuit; and the adjustable resistance circuit controls and adjusts a resistance value between the drive circuit of the display panel and the integrated end circuit;

wherein the adjustable resistance circuit comprises:

a first resistor;

a second resistor, having a resistance value different from that of the first resistor; and a switching circuit, in control connection with the first resistor and the second resistor, wherein the switching circuit is in communication with the drive circuit of the display panel to receive a switching signal;

when the switching signal received by the switching circuit is a first switching signal, the switching circuit connects the first resistor between the ground end of the drive circuit of the display panel and the ground end of the integrated end circuit board; and when the switching signal received by the switching circuit is a second switching signal, the switching circuit connects the second resistor between the ground end of the drive circuit of the display panel and the ground end of the integrated end circuit board;

wherein the drive circuit of the display panel comprises a system movement, and the switching circuit is in communication with the system movement to receive the switching signal;

the switching circuit comprises:

a D trigger;

a first switch; and a second switch;

the system movement is in communication with a control end of the D trigger to connect the switching signal, and an output end of the D trigger is connected to control ends of both the first switch and the second switch and controls the first switch or the second switch to be conducted;

a third resistor is connected between the output end of the D trigger and the first switch and the second switch, and the other end of the third resistor is connected to the ground end of the drive circuit of the display panel;

when the switching signal is the first switching signal, and a logic voltage end of the D trigger is at a high level, the first switching signal enters through the control end of the D trigger and outputs a first control signal through the output end of the D trigger, to control the first switch to be conducted and the second switch to be turned off;

when the switching signal is the second switching signal, and the logic voltage end of the D trigger is at a high level, the first switching signal enters through the control end of the D trigger and outputs a second control signal through the output end of the D trigger, to control the second switch to be conducted and the first switch to be turned off; and the system movement and the D trigger are connected through a connector.

2. The display according to claim 1, wherein the switching circuit comprises:

the first switch, wherein a first end of the first switch is coupled to the first resistor, a second end of the first switch is coupled to and connected to the ground end of the integrated end circuit board, and the control end of the first switch is coupled to the switching signal; and the second switch, wherein a first end of the second switch is coupled to the second resistor, a second end of the second switch is coupled to the ground end of the integrated end circuit board, and the control end of the second switch is coupled to the switching signal, wherein when the first switch is turned on, the second switch is turned off; and when the first switch is turned off, the second switch is turned on.

3. The display according to claim 2, wherein the control end of the first switch is positive, and the control end of the second switch is negative; or the control end of the first switch is negative, and the control end of the second switch is positive.

4. The display according to claim 2, wherein the first switch is an NMOS tube, is turned on when the switching signal is at a high level, and is turned off when the switching signal is at a low level; and the second switch is a PMOS tube, is turned on when the switching signal is at a low level, and is turned off when the switching signal is at a high level.

5. The display according to claim 1, wherein the drive circuit of the display panel comprises a timing controller, and the switching circuit is in communication with the timing controller to receive the switching signal.

6. The display according to claim 1, wherein the system movement and the D trigger are connected through the connector.

7. A ground resistor adjustment method of a display, wherein the display comprises:

a drive circuit of a display panel, an integrated end circuit, and an adjustable resistance circuit, wherein a ground end of the drive circuit of the display panel is conducted with a ground end of an integrated end circuit board through the adjustable resistance circuit;

the adjustable resistance circuit comprises:

a first resistor, a second resistor having a resistance value different from that of the first resistor, and a switching circuit in control connection with the first resistor and the second resistor, the switching circuit being in communication with the drive circuit of the display panel to receive a switching signal; and the ground resistor adjustment method comprises the following steps:

when a first switching signal is received, controlling the first resistor to be connected between the ground end of the drive circuit of the display panel and the ground end of the integrated end circuit board; and when a second switching signal is received, controlling the second resistor to be connected between the ground end of the drive circuit of the display panel and the ground end of the integrated end circuit board;

wherein the drive circuit of the display panel comprises a system movement, and the switching circuit is in communication with the system movement to receive the switching signal;

the switching circuit comprises:

a D trigger;

a first switch; and a second switch:

the system movement is in communication with a control end of the D trigger to connect the switching signal, and an output end of the D trigger is in control connection with both the first switch and the second switch and controls the first switch or the second switch to be conducted;

a third resistor is connected between the output. end of the D trigger and the first switch and the second switch, and the other end of the third resistor is connected to the ground end of the drive circuit of the display panel; and the step of when a first switching signal is received, controlling the first resistor to be connected between the ground end of the drive circuit of the display panel and the mound end of the integrated end circuit board; and when a second switching signal is received, controlling the second resistor to be connected between the ground end of the drive circuit of the display panel and the ground end of the integrated end circuit board comprises:

when the switching signal is the first switching signal, and a logic voltage end of the D trigger is at a high level, the first switching signal enters through the control end of the D trigger and outputs a first control signal through the output end of the D trigger, to control the first switch to be conducted and the second switch to be turned off.

8. The ground resistor adjustment method of a display according to claim 7, wherein the drive circuit of the display panel comprises a timing controller, and the switching circuit is in communication with the timing controller to receive the switching signal;

the switching circuit comprises the first switch and the second switch; and the step of when a first switching signal is received, controlling the first resistor to be connected between the ground end of the drive circuit of the display panel and the ground end of the integrated end circuit board; and when a second switching signal is received, controlling the second resistor to be connected between the ground end of the drive circuit of the display panel and the ground end of the integrated end circuit board comprises:

when the switching signal is at a high level, the first switch is conducted, a control end of the first switch is in communication with the timing controller to receive the switching signal, a first end of the first switch is in communication with the first resistor and the ground end of the drive circuit of the display panel, a second end of the first switch is in communication with the ground end of the integrated end circuit board, and a ground resistor connected between the ground end of the drive circuit of the display panel and the ground end of the integrated end circuit board is the first resistor.

9. The ground resistor adjustment method of a display according to claim 8, wherein when the switching signal is at a low level, when the second switch is turned on, a control end of the second switch is in communication with the timing controller to receive the switching signal, a first end of the second switch is in communication with the second resistor and the ground end of the drive circuit of the display panel, a second end of the second switch is in communication. with the ground end of the integrated end circuit board, and a ground resistor connected between the ground end of the chive circuit of the display panel and the ground end of the integrated end circuit board is the second resistor.

10. The ground resistor adjustment method of a display according to claim 7, wherein when the switching signal is a second switching signal, and the logic voltage end of the D trigger is at a high level, the first switching signal enters through the control end of the D trigger and outputs a second control signal through the output end of the D trigger, to control the second switch to be conducted and the first switch to be turned off.

11. A display apparatus, comprising a display, comprising:

a drive circuit of a display panel;

an integrated end circuit; and an adjustable resistance circuit, wherein a ground end of the drive circuit of the display panel is conducted with a ground end of an integrated end circuit board through the adjustable resistance circuit; and the adjustable resistance circuit controls and adjusts a resistance value between the drive circuit of the display panel and the integrated end circuit;

wherein the adjustable resistance circuit comprises:

a first resistor;

a second resistor, having a resistance value different from that of the first resistor; and a switching circuit, in control connection with the first resistor and the second resistor, wherein the switching circuit is in communication with the drive circuit of the display panel to receive a switching signal;

when the switching signal received by the switching circuit is a first switching signal, the switching circuit connects the first resistor between the ground end of the drive circuit of the display panel and the ground end of the integrated end circuit board; and when the switching signal received by the switching circuit is a second switching signal, the switching circuit connects the second resistor between the ground end of the drive circuit of the display panel and the ground end of the integrated end circuit board;

wherein the drive circuit of the display panel comprises a system movement, and the switching circuit is in communication with the system movement to receive the switching signal;

the switching circuit comprises:

a D trigger;

a first switch; and a second switch;

the system movement is in communication with a control end of the D trigger to connect the switching signal, and an output end of the D trigger is connected to control ends of both the first switch and the second switch and controls the first switch or the second switch to be conducted;

a third resistor is connected between the output end of the D trigger and the first switch and the second switch, and the other end of the third resistor is connected to the around end of the drive circuit of the display panel;

when the switching signal is the first switching signal, and a logic voltage end of the D trigger is at a high level, the first switching signal enters through the control end of the D trigger and outputs a first control signal through the output end of the D trigger, to control the first switch to be conducted and the second switch to be turned off;

when the switching signal is the second switching signal, and the logic voltage end of the D trigger is at a high level, the first switching signal enters through the control end of the D trigger and outputs a second control signal through the output end of the D trigger, to control the second switch to be conducted and the first switch to be turned off; and the system movement and the D trigger are connected through a connector.

12. The display apparatus according to claim 11, wherein the switching circuit comprises:

the first switch, wherein a first end of the first switch is coupled to the first resistor, a second end of the first switch is coupled to and connected to the ground end of the integrated end circuit board, and the control end of the first switch is coupled to the switching signal; and the second switch, wherein a first end of the second switch is coupled to the second resistor, a second end of the second switch is coupled to the ground end of the integrated end circuit board, and the control end of the second switch is coupled to the switching signal, wherein when the first switch is turned on, the second switch is turned off; and when the first switch is turned off, the second switch is turned on.

13. The display apparatus according to claim 12, wherein the control end of the first switch is positive, and the control end of the second switch is negative; or the control end of the first switch is negative, and the control end of the second switch is positive; and the first switch is an NMOS tube, is turned on when the switching signal is at a high level, and is turned off when the switching signal is at a low level; and the second switch is a PMOS tube, is turned on when the switching signal is at a low level, and is turned off when the switching signal is at a high level.

14. The display apparatus according to claim 11, wherein the drive circuit of the display panel comprises a timing controller, and the switching circuit is in communication with the timing controller to receive the switching signal.

15. The display apparatus according to claim 11, wherein the display apparatus is one of a twisted nematic display apparatus, an in-plane switching display apparatus, and a multi-domain vertical alignment display apparatus.

* * * * *